US007614402B2

(12) United States Patent
Gomes

(10) Patent No.: US 7,614,402 B2
(45) Date of Patent: Nov. 10, 2009

(54) SIMULATED CIGARETTE

(76) Inventor: Roberta Gomes, 42 Radio Ave., Miller Place, NY (US) 11764-3123

( * ) Notice: Subject to any disclaimer, the term of this patent is extended or adjusted under 35 U.S.C. 154(b) by 712 days.

(21) Appl. No.: 11/368,712

(22) Filed: Mar. 6, 2006

(65) Prior Publication Data

US 2006/0196515 A1 Sep. 7, 2006

Related U.S. Application Data

(60) Provisional application No. 60/659,011, filed on Mar. 4, 2005.

(51) Int. Cl.
*A24F 47/00* (2006.01)

(52) U.S. Cl. ..... 131/202; 131/337

(58) Field of Classification Search ..... 131/337, 131/202

See application file for complete search history.

(56) References Cited

U.S. PATENT DOCUMENTS 2,863,461 A * 12/1958 Frost, Jr. ..... 131/337
6,041,789 A 3/2000 Bankert et al.
6,619,293 B1 9/2003 Siadto
7,240,678 B2 * 7/2007 Crooks et al. ..... 131/212.2
2006/0272663 A1 * 12/2006 Dube et al. ..... 131/337
2007/0012327 A1 * 1/2007 Karles et al. ..... 131/337

* cited by examiner

*Primary Examiner*—Carlos Lopez
(74) *Attorney, Agent, or Firm*—James Ray & Assoc.

(57) ABSTRACT

The invention is directed to a simulated cigarette for use as a smoking cessation aid comprising a cylindrical member having a predetermined size and shape and a filter member formed at one end of the cylindrical member. The filter member has a predetermined size and shape capable of being comfortably held between a user's lips. An opening is formed within the end of the filter member that is held between the user's lips. A hollow portion is formed within at least the filter member. Flavoring, such as peppermint or spearmint, is placed within the hollow portion. Upon the application of pressure to the filter member, the flavoring is dispersed through the opening of the filter member and into the user's mouth to aid in the reduction of the user's urge for a cigarette.

2 Claims, 2 Drawing Sheets

SIMULATED CIGARETTE

CROSS-REFERENCES TO RELATED APPLICATIONS

This application is based on Provisional Application Ser. No. 60/659,011, filed Mar. 4, 2005.

FIELD OF THE INVENTION

The present invention relates, in general, to a smoking cessation aid, and more particularly, to a smoking cessation aid, which is a simulated cigarette, that reduces a user's urge for a cigarette.

BACKGROUND OF THE INVENTION

Nicotine addiction is the largest hurdle to overcome in the battle to quit smoking. In addition to this hurdle, oral fixation is another addiction that the smoker must overcome. Most cigarette users find the comforting feel of a cigarette hard to replace. The common after-dinner cigarette, the cigarette in the car and other habitual cigarette cravings are hard to replace.

While numerous inventions have been developed to help one overcome nicotine addiction such as nicotine gum or nicotine patches, little has been done to assist smokers in overcoming their oral fixation. U.S. Pat. No. 6,041,789 to Bankert et al teaches a cigarette substitute device which, in response to suction supplied by a user, delivers a nicotine-simulating vapor mixture having a cigarette-like taste and aroma. A disadvantage to this device is that the unpleasant taste and odor of a cigarette is still present on the user. U.S. Pat. No. 6,619,293 teaches a tobacco alternative wherein a cigarette is prepared from tea-leaves, which can be smoked like a regular cigarette. A disadvantage of this device is that it still requires one to smoke, posing a fire hazard, and it emits fumes, which may be bothersome to other people.

There is a need in the art for a healthy, smoke-free replacement for the feeling of holding and smoking a cigarette. There is also a need in the art for a specially designed pseudo-cigarette that is pleasant smelling and features a fresh, mint taste.

SUMMARY OF THE INVENTION

The invention is directed to a simulated cigarette for use as a smoking cessation aid comprising a cylindrical member having a predetermined size and shape and a filter member formed at one end of the cylindrical member. The filter member has a predetermined size and shape capable of being comfortably held between a user's lips. An opening is formed within the end of the filter member that is held between the user's lips. A hollow portion is formed within at least the filter member. Flavoring, such as peppermint or spearmint, is placed within the hollow portion. Upon the application of pressure to the filter member, the flavoring is dispersed through the opening of the filter member and into the user's mouth to aid in the reduction of the user's urge for a cigarette.

OBJECTS OF THE INVENTION

It is therefore the primary object of the present invention to provide a smoking cessation aid which is a healthy replacement for the feeling of holding and smoking a cigarette.

It is another object of the present invention to provide a smoking cessation aid, which is a specially designed, smoke-free pseudo-cigarette that features a fresh, mint taste.

It is still yet another object of the present invention to provide a smoking cessation aid the does not emit noxious fumes.

It is still yet another object of the present invention to provide a smoking cessation aid that simulates the size and shape of an actual cigarette to assist one in overcoming their oral fixation of holding a cigarette.

In addition to the above-described objects and advantages of the smoking cessation aid, various other objects and advantages of the present invention will become more readily apparent to the persons who are skilled in the same and related arts from the following more detailed description of the invention, particularly, when such description is taken in conjunction with the attached drawing figures and the appended claims.

DETAILED DESCRIPTION OF THE INVENTION

Figure 1:
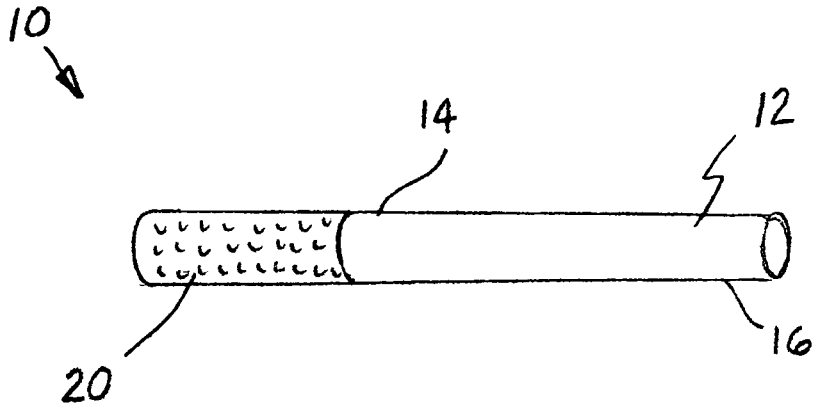
FIG. 1 is a side view of the simulated cigarette according to a first embodiment of the present invention to be used as a smoking cessation aid.

Prior to proceeding to a more detailed description of the invention, it should be noted that identical components having identical functions have been designated with identical reference numerals for the sake of clarity.

Figure 2:
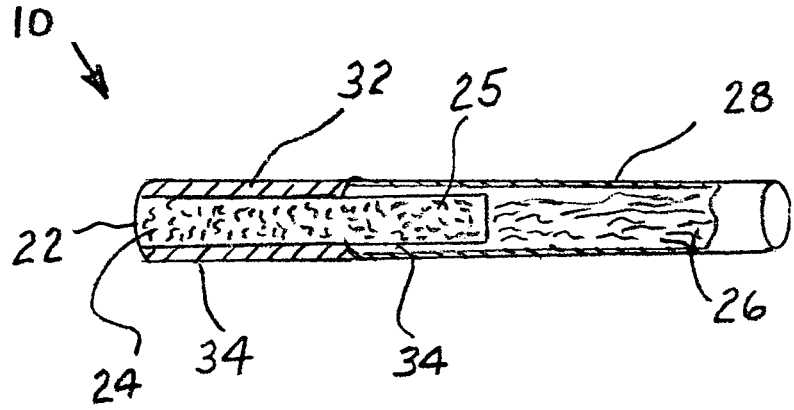
FIG. 2 is a cut-away view of the simulated cigarette of FIG. 1.

Now referring to FIGS. 1-2, illustrated therein is the simulated cigarette, generally indicated as 10, for use a smoking cessation aid. The simulated cigarette 10 comprises a cylindrical member 12 having a predetermined size and shape. The simulated cigarette 10 includes a first 14 and second portion 16. A filter member 20 is formed at an end of the first portion 14 of the cylindrical member 10. The filter portion 20 has a predetermined size and shape capable of being comfortably held between a user's lips. An opening 22 is formed within an end of the filter member 20. A hollow portion 24 is formed within the filter member 20. A flavoring means 25 is placed within the hollow portion 24. The flavoring means 25 is capable of dispersing flavoring through the opening 22 of the filter member 22 and into a user's mouth upon the application of pressure to the filter member 22 to aid in the reduction of a user's urge for a cigarette.

As illustrated in FIG. 2, the cylindrical member 12 comprises a fibrous member 26 wrapped in an enclosing means 28. This fibrous member 26 can comprise a hard packed cotton material or any other well known, preferably inexpensive material, which simulates the touch and feel of an actual cigarette. The enclosing means 28 can comprise a soft and durable paper wrapper or any other well known cigarette wrapping material.

As shown in FIGS. 1-2, according to a first embodiment of the invention, the filter member 20 comprises an extension of the cylindrical member 12. Accordingly, the filter member 20 also comprises a fibrous member 32 wrapped in an enclosing means 34. This fibrous member 32 can comprise hard packed cotton or any other well known, preferably inexpensive material, which simulates the touch and feel of an actual cigarette filter. The enclosing means 34 comprises a soft and durable paper wrapper or any other well known cigarette wrapping material.

The predetermined size and shape of the cylindrical member 12 in combination with the predetermined size and shape of the filter member 20 approximates the size, shape, look, and feel of a cigarette. This particular design assists as a smoking cessation aid as the user feels as if he/she were holding an actual cigarette in their mouth and/or hand.

The hollow portion 24 in which the flavoring means 25 is placed comprises a tube 34, preferably formed from a plastic material, which extends through at least the filter member 20 for containing the flavoring means 25 therein. Preferably, the plastic tube 34 extends at least partway into the second portion 16 of the cylindrical member 12.

The application of pressure to the filter member 14 resulting in the release of flavoring into the user's mouth can be achieved in a variety of ways. One technique can include the application of an external pressure to the filter member 14 via the user's lips or hands. Another technique can include the application of a vacuum, or inhalation, from the user to the opening 22 of the filter member 14.

The flavoring means 25 comprises one of a peppermint, spearmint, cinnamon, and menthol flavored liquid. Any other well known flavoring may be used in the invention.

Alternatively, the flavoring means 25 can be a peppermint, spearmint, cinnamon or menthol flavored tablet or powder which, upon the application of an inhalation pressure thereto, can result in the user breathing in the flavoring, similar to inhaling smoke from a cigarette.

Figure 4:
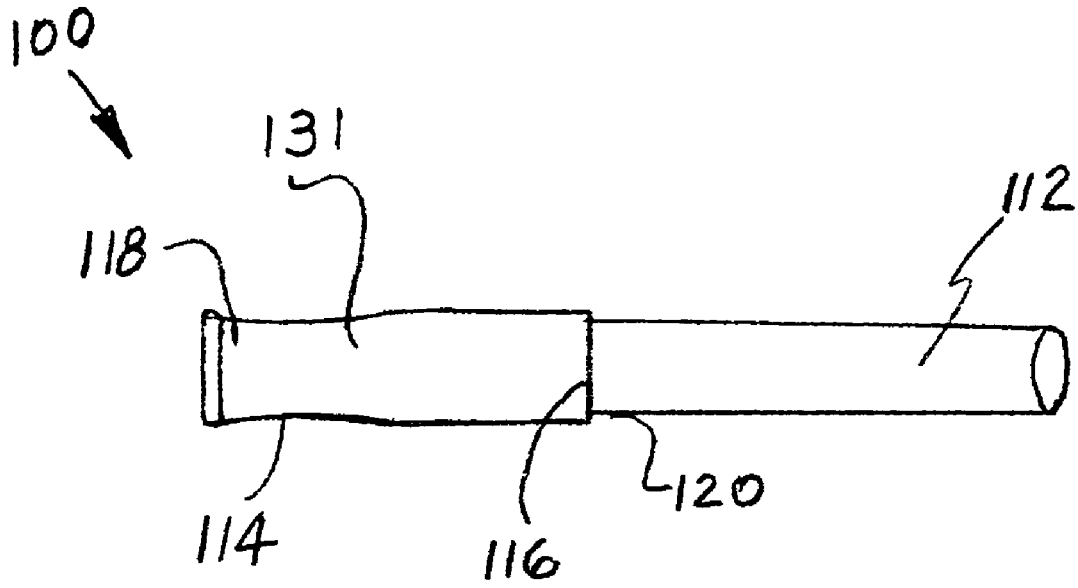
FIG. 4 is a side view of the simulated cigarette according to a second embodiment of the present invention.
Figure 5:
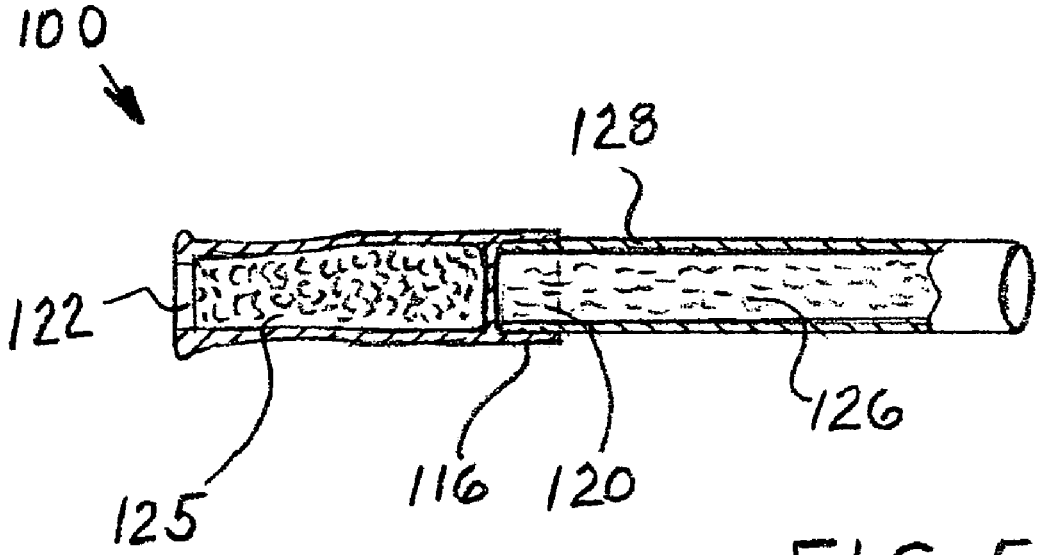
FIG. 5 is a cut-away view of the simulated cigarette of FIG. 4.

FIGS. 4-5 show the simulated cigarette of the invention according to a second embodiment. In this second embodiment, the simulated cigarette 100 includes a hollow filter member 114 having a first 116 and second 118 end. The first end 116 is attached to one end 120 of the cylindrical member 112. The second end 118 has a predetermined size and shape capable of being comfortably held between a user's lips. The predetermined size and shape of the cylindrical member 112 in combination with the predetermined size and shape of the hollow filter member 114 approximates the size, shape, look and feel of a cigarette. An opening 122 is formed within the second end 118 of the filter member 114. A flavoring means 125, as shown in FIG. 5, is placed within the hollow filter member 114. This flavoring means 125 is capable of dispersing flavoring through the opening 122 and into a user's mouth upon the application of pressure to the filter member 114 to aid in the reduction of a user's urge for a cigarette.

The hollow filter member 114 may be formed from a flexible plastic material. At least a portion of the hollow filter member 114 may have a textured surface 131 to assist the user in grasping the simulated cigarette 100.

Figure 3:
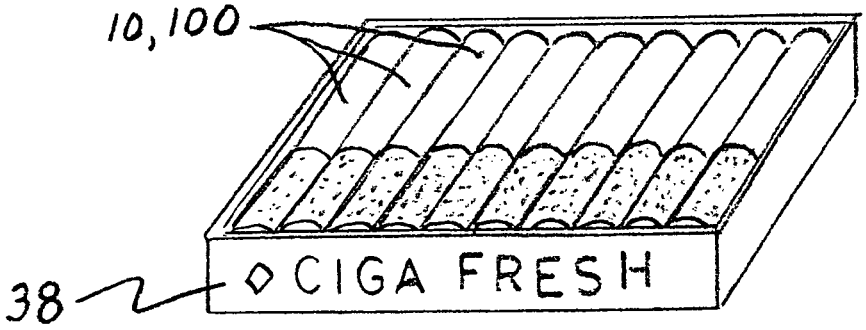
FIG. 3 shows a container including a plurality of the simulated cigarettes of FIG. 1.

The simulated cigarette 10, 100 of the invention can be sold individually or in a pack 38, as shown in FIG. 3, in a manner similar to cigarettes. When the urge for a cigarette strikes, the user simply reaches for the simulated cigarette of the invention. This invention, as a smoking cessation aid, satisfies the urge to bring a cigarette to the lips. Instead of burning hazardous tobacco, the user can enjoy a wonderful and satisfying mint flavor instead.

Although the invention has been shown in connection with certain specific embodiments, it will be readily apparent to those skilled in the art that various changes in form and arrangement of parts may be made to suit requirements without departing from the spirit and scope of the invention.

I claim:

1. A simulated cigarette for use as a smoking cessation aid, said simulated cigarette comprising:

(a) a cylindrical member having a predetermined size and shape, said cylindrical member having a first and second portion;

(b) a filter member formed at an end of said first portion of said cylindrical member, said filter member having a predetermined size and shape capable of being comfortably held between a user's lips;

(c) an opening within an end of said filter member;

(d) a hollow portion formed within said filter member; and (e) a flavoring means placed within said hollow portion, said flavoring means capable of dispersing flavoring through said opening of said filter member and into a user's mouth upon the application of pressure to said filter member to aid in the reduction of a user's urge for a cigarette;

wherein said hollow portion comprises a plastic tube which extends through said filter member for containing said flavoring means therein.

2. A simulated cigarette as recited in claim 1 wherein said plastic tube extends at least partway into said second portion of said cylindrical member.

* * * * *